US005146858A

United States Patent [19]

Tokuda et al.

[11] Patent Number: 5,146,858

[45] Date of Patent: Sep. 15, 1992

[54] BOILER FURNACE COMBUSTION SYSTEM

[75] Inventors: Kimishiro Tokuda; Masaharu Oguri, both of Nagasaki; Shuzo Naito, Tokyo, all of Japan

[73] Assignee: Mitsubishi Jukogyo Kabushiki Kaisha, Tokyo, Japan

[21] Appl. No.: 593,021

[22] Filed: Oct. 3, 1990

[30] Foreign Application Priority Data

Oct. 3, 1989 [JP] Japan ..... 1-115882[U]

[51] Int. Cl.[5] ..... F23K 5/00; F23D 1/00

[52] U.S. Cl. ..... 110/261; 110/263; 110/347; 110/264

[58] Field of Search ..... 110/261, 263, 245, 347

[56] References Cited

U.S. PATENT DOCUMENTS

| | | | |
|---|---|---|---|
| 3,387,574 | 6/1968 | Mullen | 110/347 |
| 4,294,178 | 10/1981 | Borio et al. | 110/347 |
| 4,304,196 | 12/1981 | Chadshay | 110/263 |
| 4,434,727 | 3/1984 | McCartney | 110/261 |
| 4,434,747 | 3/1984 | Chadshay | 110/347 |
| 4,438,709 | 3/1984 | Borio et al. | 110/263 |
| 4,501,204 | 2/1985 | McCartney et al. | 110/347 |
| 4,655,148 | 4/1987 | Winship | 110/347 |
| 4,672,900 | 6/1987 | Santalla et al. . | |
| 4,715,301 | 12/1987 | Bianca et al. | 110/264 |
| 4,722,287 | 2/1988 | Anderson et al. | 110/347 |
| 4,962,711 | 10/1990 | Yamanchi et al. | 110/245 |

FOREIGN PATENT DOCUMENTS

| | | |
|---|---|---|
| 2837156 | 3/1979 | Fed. Rep. of Germany . |
| 8525256.5 | 2/1987 | Fed. Rep. of Germany . |

*Primary Examiner*—Henry C. Yuen

*Attorney, Agent, or Firm*—Wenderoth, Lind & Ponack

[57] ABSTRACT

A boiler furnace combustion system typically includes main burners disposed on side walls of or at corners of a square-barrel-shaped boiler furnace having a vertical axis, the burner axes being directed tangentially to an imaginary cylindrical surface coaxial to the furnace. Air nozzles are disposed in the boiler furnace at a level above the main burners, so that unburnt fuel left in a reducing atmosphere or a lower oxygen concentration atmosphere of a main burner combustion region can be perfectly burnt by additional air blown through the air nozzles. The present invention provides two groups of air nozzles disposed at higher and lower levels, respectively. The air nozzles at the lower level are provided at the corners of the boiler furnace with their axes directed tangentially to a second imaginary coaxial cylindrical surface having a larger diameter than the first imaginary coaxial cylindrical surface. And, the air nozzles at the higher level are provided at the centers of the side wall surfaces of the boiler furnace with their axes directed tangentially to a third imaginary coaxial cylindrical surface having a smaller diameter than the second imaginary coaxial cylindrical surface.

4 Claims, 8 Drawing Sheets

BOILER FURNACE COMBUSTION SYSTEM

BACKGROUND OF THE INVENTION

1. Field of the Invention:

The present invention relates to a boiler furnace combustion system, and more particularly to improvements in an electric utility or industrial boiler furnace combustion system.

2. Description of the Prior Art:

At first, one example of a boiler furnace in the prior art will be explained with reference to FIGS. 5 to 7. Among these figures, FIG. 5 is a vertical cross-sectional view; FIG. 6 is a horizontal cross-sectional view taken along line VI—VI in FIG. 5; and FIG. 7 is another horizontal cross-sectional view taken along line VII—VII in FIG. 5.

In these figures, reference numeral 01 designates a boiler furnace main body, numeral 02 designates main burner wind boxes, numeral 03 designates main burner air nozzles, numeral 04 designates main burner fuel injection nozzles, numeral 05 designates air ducts for introducing air to the main burners, numeral 06 designates fuel feed pipes, numeral 07 designates additional air ducts, numeral 09 designates flames, numeral 10 designates air for the main burners, numeral 11 designates fuel such as pulverized coal, petroleum, gaseous fuel or the like, numeral 12 designates additional air, numeral 13 designates unburnt combustion gas, numeral 14 designates combustion exhaust gas, numeral 15 designates wind boxes, numeral 16 designates air nozzles, and numeral 20 designates imaginary cylindrical surfaces.

At lower corner portions of a square-barrel-shaped boiler furnace main body 01 having a nearly vertical axis are respectively provided main burner wind boxes 02, and at upper corner portions of the same main body are respectively provided wind boxes 15 for additional air (hereinafter abbreviated as AA). Within each main burner wind box 02 there is provided main burner fuel injection nozzles 04 and main burner air nozzles 03 extending nearly horizontally.

Fuel 11 is fed from a fuel feed installation (not shown) to the main burner fuel injection nozzles 04 through the fuel feed pipes 06 and is injected into the boiler furnace 01. On the other hand, main burner air 10 is fed from a ventilating installation (not shown) through the main burner air ducts 05 to the main burner wind boxes 02, and is blown into the boiler furnace 01 through the main burner air nozzles 03.

The injection of the fuel 11 and of the main burner air 10 is effected in a direction tangential to an imaginary cylindrical surface 20 which is located at the central portion of the boiler furnace 01. The fuel 11 injected into the boiler furnace 01 along the tangential direction is ignited by an ignition source (not shown) to form flames 09, and as the fuel diffuses and mixes with the main burner air 10 injected in the tangential direction through the main burner air nozzles 03, combustion is continued.

The main burner air 10 is fed at a rate lower than an air feed rate that is theoretically necessary for combusting the fuel 11 injected into the boiler furnace 01. Therefore, the interior portion of the boiler furnace 01 below the AA blowing portion is held under a reducing atmosphere. Accordingly, the combustion of the fuel 11 produces unburnt combustion gas 13 containing unburnt fuel at the portion below the AA blowing portion.

The AA 12 is fed from a ventilating installation (not shown) which also feeds the main burner air 10, or from a separately disposed ventilating installation (not shown) through the AA ducts 07. The AA 12 is blown into the boiler furnace 01 in a tangential manner, like the main burner air 10, through the AA air nozzles 16 disposed nearly horizontally in AA wind boxes 15. Normally, the injection of the AA 12 is effected in the same tangential direction as the main burner air 10 with respect to the imaginary cylindrical surface 20. The flow rate of the AA 12 is such that a sufficient amount of oxygen, i.e. an amount necessary for perfectly burning unburnt fuel in the unburnt combustion gas 13, is fed into the boiler furnace 01.

The AA 12 blown into the boiler furnace 01 is mixed with the unburnt combustion gas 13 by diffusion, thus causing the unburnt fuel in the unburnt combustion gas 13 to burn perfectly, and is exhausted to the outside of the boiler furnace 01 as combustion exhaust gas 14.

In such a boiler furnace in the prior art, the combustion of the fuel 14 injected through the main burner fuel injection nozzles 04 produces some unburnt combustion gas 13 due to the fact that the flow rate of the main burner air 10 is less than the theoretical air flow rate. And, the interior portion of the boiler furnace below the AA blowing portion is under a reducing atmosphere. Consequently, in that portion below the AA blowing portion, the amount of nitrogen oxides (hereinafter represented by $NO_x$) produced by the combustion of the fuel 11 is small, and instead intermediate products such as ammonia ($NH_3$), cianic acid (HCN) and the like are produced.

Subsequently, in the AA blowing portion, it is desired to completely combust unburnt components of the unburnt combustion gas 13 by injecting AA 12 through the AA blowing nozzles 16. At that time since the intermediate products such as $NH_3$, HCN and the like tend to be oxidized and transformed into $NO_x$, the injection of AA 12 is carried out in a relatively low-temperature (about 1000°-1200° C.) atmosphere within the boiler furnace 01 for the purpose of suppressing the transformation rate of the intermediate products into $NO_x$.

And because the flow rate of the main burner air 10 is less than the theoretical air flow rate necessary for the air to completely combust with the fuel 11, the unburnt combustion gas 13 rises while swirling. As the unburnt combustion gas 13 rises, the outer diameter of the swirling flow of the unburnt combustion gas 13 gradually becomes large, and in the proximity of the AA blowing portion, the amount of unburnt combustion gas 13 flowing along the wall of the boiler furnace 01 increases.

The blowing momentum of the AA 12 is about 1/5 to ⅓ that of the blowing momentum of the main burner air 10, provided that the blowing velocities are equal to each other. The AA 12 blowing through the AA blowing nozzles 16 at the respective corner portions both diffuses and mixes with the main flow portion of the unburnt combustion gas 13, and penetrates through the main flow portion and flows towards the central portion of the boiler furnace 01. The momentum of the AA 12 flowing towards the central portion of the boiler furnace 01 is attenuated due to the facts that the AA 12 has penetrated through the main flow portion of the unburnt combustion gas and that the distance from the AA blowing nozzle 16 to the central portion of the boiler furnace 01 is long. Hence, the AA 12 does not diffuse or mix with the unburnt combustion gas 13 in the proximity of the central portion of the boiler furnace 01.

Accordingly, the AA 12 rises without contributing to the completion of the combustion of the unburnt combustion gas, and it is exhausted from the outlet of the boiler furnace 01.

Therefore, in order to complete the combustion of the unburnt components of the unburnt combustion gas 13 within the boiler furnace 01 in the prior art, countermeasures such as (1) increasing a total combustion air flow rate (a flow rate of main burner air 10 + a flow rate of AA 12), (2) lengthening the time in which it takes combustion gas from the AA blowing portion to flow to the outlet of the boiler furnace 01, (3) weakening the reducing atmosphere under the AA blowing portion by increasing a flow rate of the main burner air 10, or the like are necessary. However, countermeasures (1) and (3) are disadvantageous in view of the production of $NO_x$, and the countermeasure (2) is disadvantageous in view of cost.

As described above, the boiler furnace combustion system in the prior art presents problems in connection with the diffusion and mixing of the AA 12 and the unburnt combustion gas 13. Therefore, there is a problem to be resolved in that if one intends to decrease $NO_x$ production, the amount of unburnt fuel is increased, while if one intends to decrease the amount of unburnt fuel remaining, $NO_x$ reduction is not sufficient.

SUMMARY OF THE INVENTION

It is therefore one object of the present invention to provide an improved boiler furnace combustion system, in which both an unburnt fuel component and an $NO_x$ content in combustion exhaust gas are low and which does not require a large installation cost.

The boiler furnace combustion system includes a plurality of main burners disposed nearly horizontally on side wall surfaces or at corner portions of a square-barrel-shaped boiler furnace having a vertical axis with axes of the burners directed tangentially to a cylindrical surface having its axis aligned with the axis of said boiler furnace, and a plurality of nozzles for injecting additional air and disposed nearly horizontally in said boiler furnace at a higher level than said main burners. A main burner combustion region, in which fuel from said main burners and air are injected, is held under a reducing atmosphere or an atmosphere of a low oxygen concentration of 1% or less, and that fuel not burnt in said main burner combustion region is perfectly burnt by the additional air blown through said nozzles. The system is characterized in that said plurality of nozzles for injecting additional air are provided in at least two groups at upper and lower levels of the boiler furnace, respectively. The nozzles for injecting additional air at the lower level are provided at corner portions of said boiler furnace and have their nozzle axes directed tangentially to a second cylindrical surface having its axis aligned with the axis of said boiler furnace and having a larger diameter than that of first said cylindrical surface. The nozzles for injecting additional air at the higher level are provided at central portions of the side wall surfaces of said boiler furnace and have their nozzle axes directed tangentially to a third cylindrical surface having its axis aligned with the axis of said boiler furnace and having a smaller diameter than that of said second cylindrical surface.

According to the present invention, since the temperature of the unburnt combustion gas becomes lower as the gas nears a furnace wall, by blowing additional air through the air nozzles (lower level) provided at the corner portions of the boiler furnace in the direction tangential to the second cylindrical surface close to the wall surface and having a larger diameter, the additional air is reliably diffused and mixed with the unburnt combustion gas. In addition, by blowing additional air through the air nozzles (higher level) provided at the central portions of the side wall surfaces of the boiler furnace in a direction tangential to the third cylindrical surface having a smaller diameter than that of the second cylindrical surface, that is, towards the central portion of the boiler furnace, the unburnt combustion gas and additional air are diffused and mixed uniformly in a reliable manner.

The above-mentioned and other objects, features and advantages of the present invention will become more apparent by referring to the following description of preferred embodiments of the invention taken in conjunction with the accompanying drawings.

DETAILED DESCRIPTION OF THE PREFERRED EMBODIMENT

Figure 1:
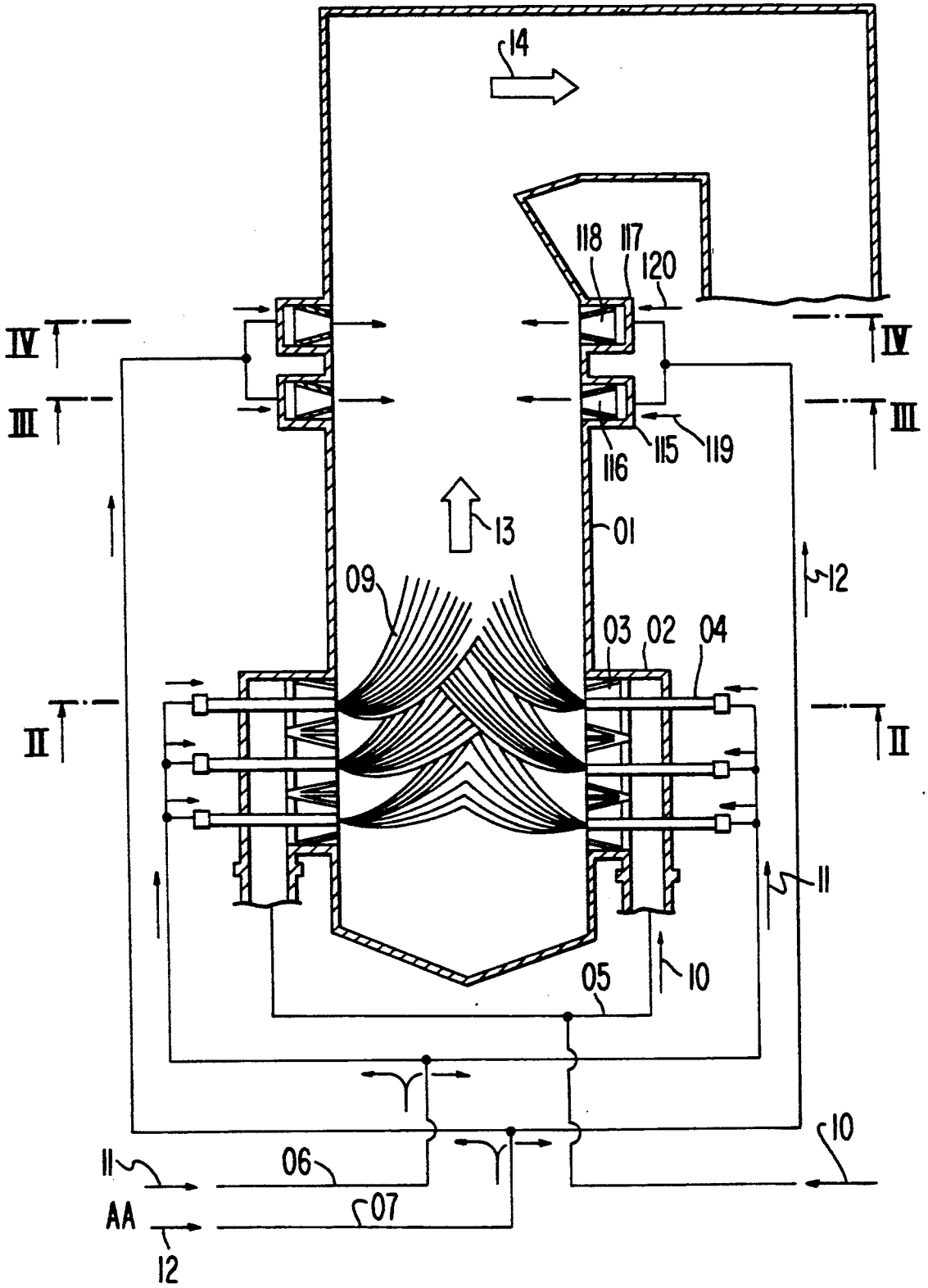
FIG. 1 is a longitudinal cross-sectional view of one preferred embodiment of the present invention.
Figure 2:
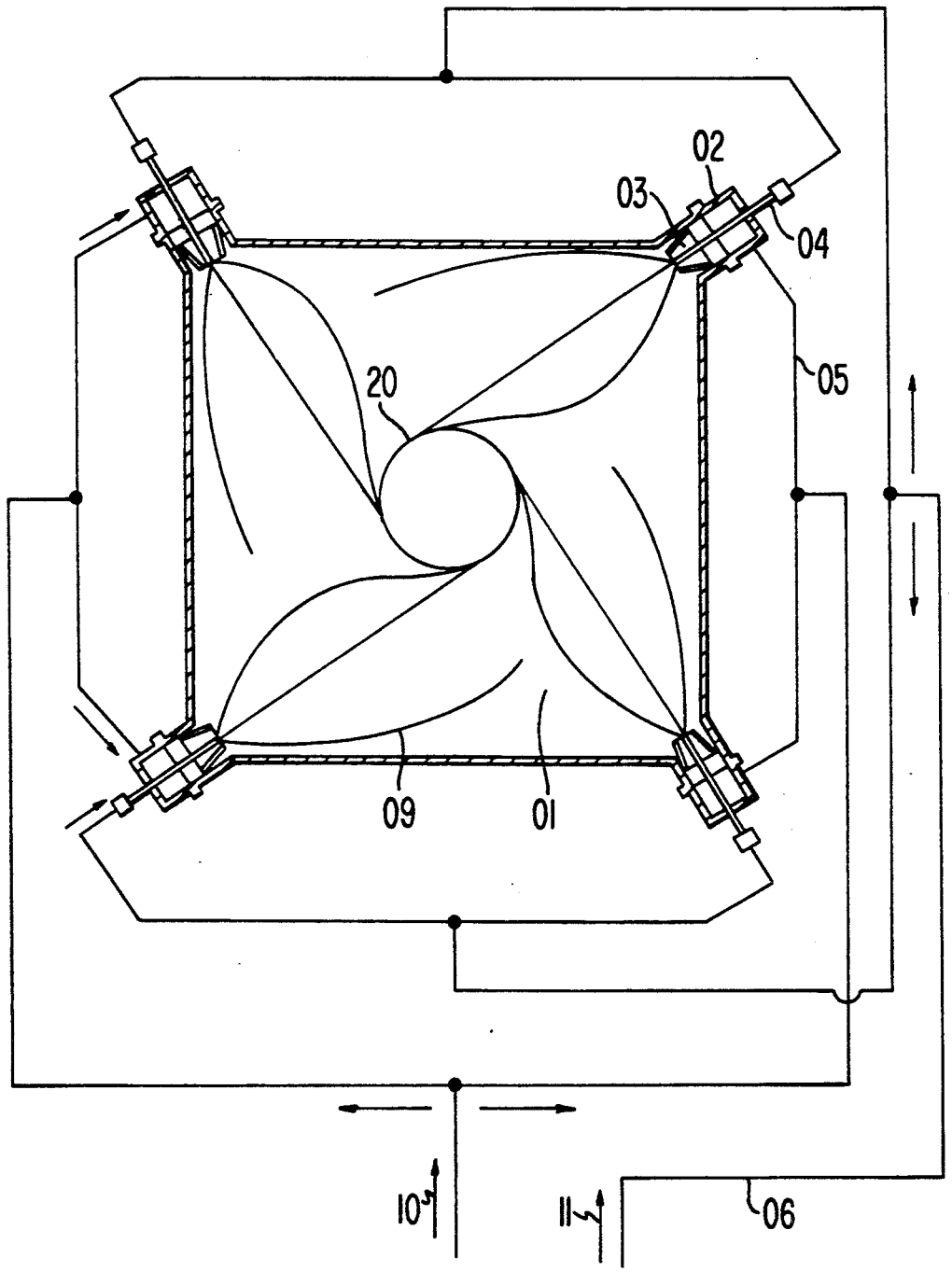
FIG. 2 is a transverse cross-sectional view of the same taken along line II—II in FIG. 1.
Figure 3:
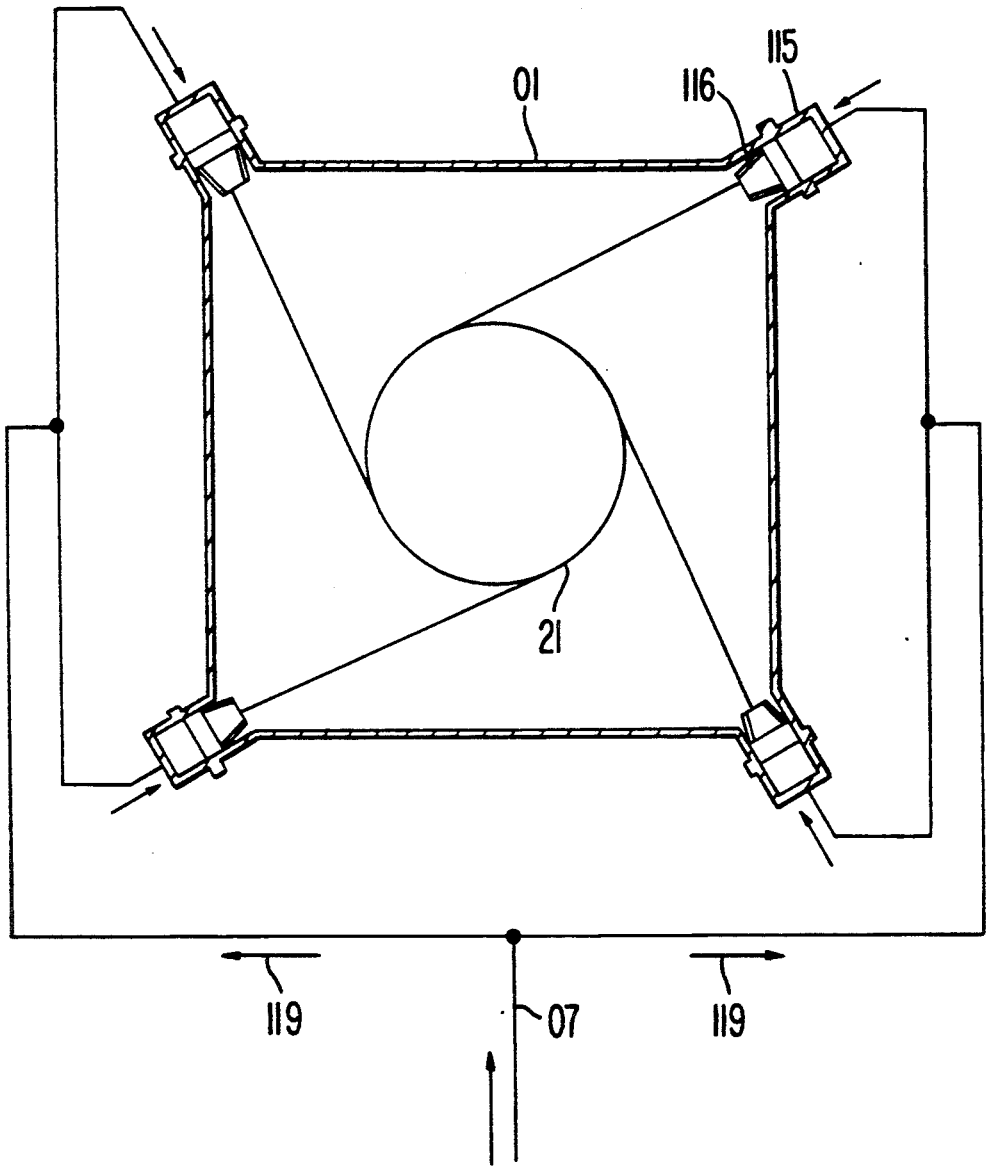
FIG. 3 is another transverse cross-sectional view of the same taken along line III—III in FIG. 1.
Figure 4:
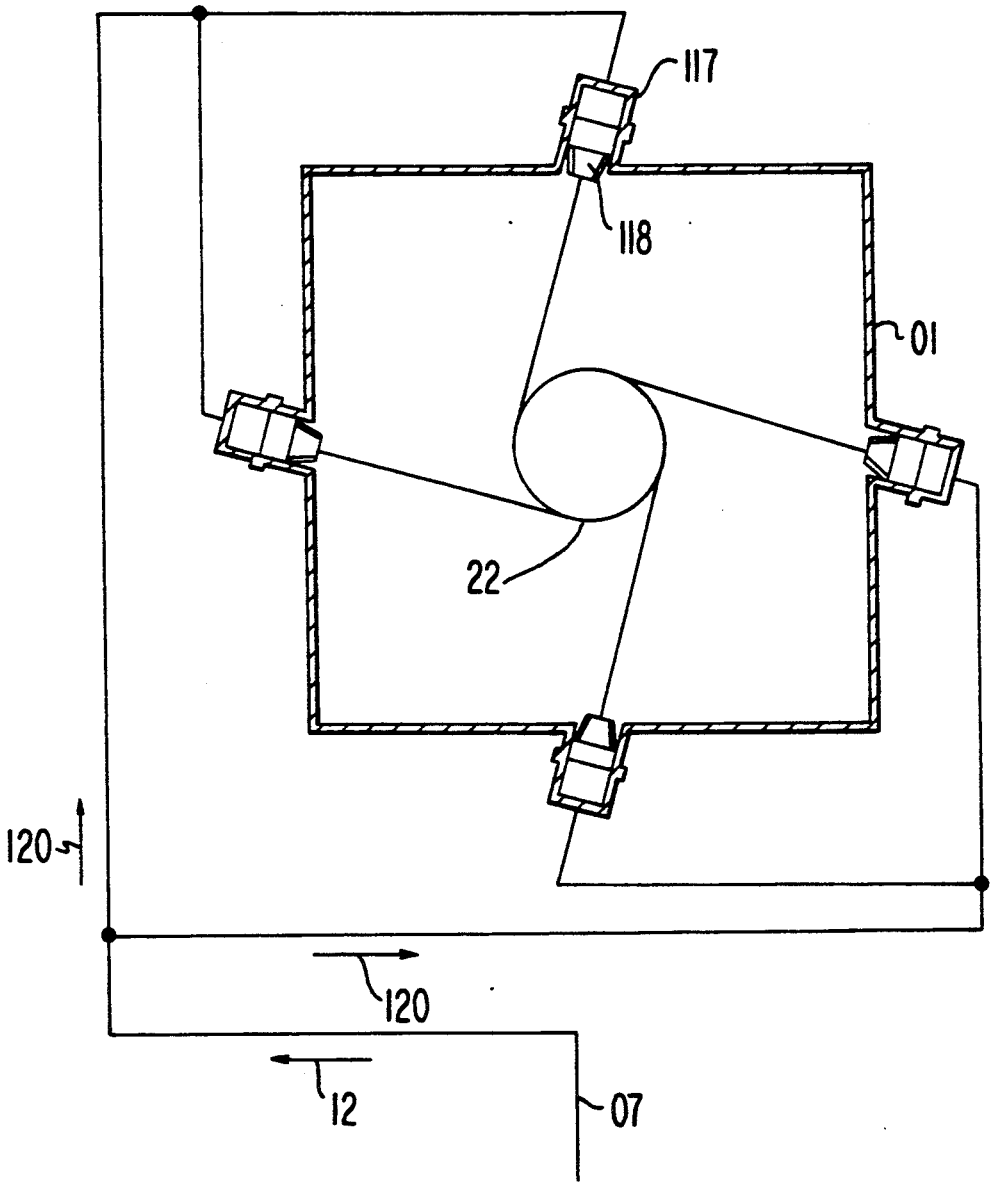
FIG. 4 is still another transverse cross-sectional view of the same taken along line IV—IV in FIG. 1.
Figure 5:
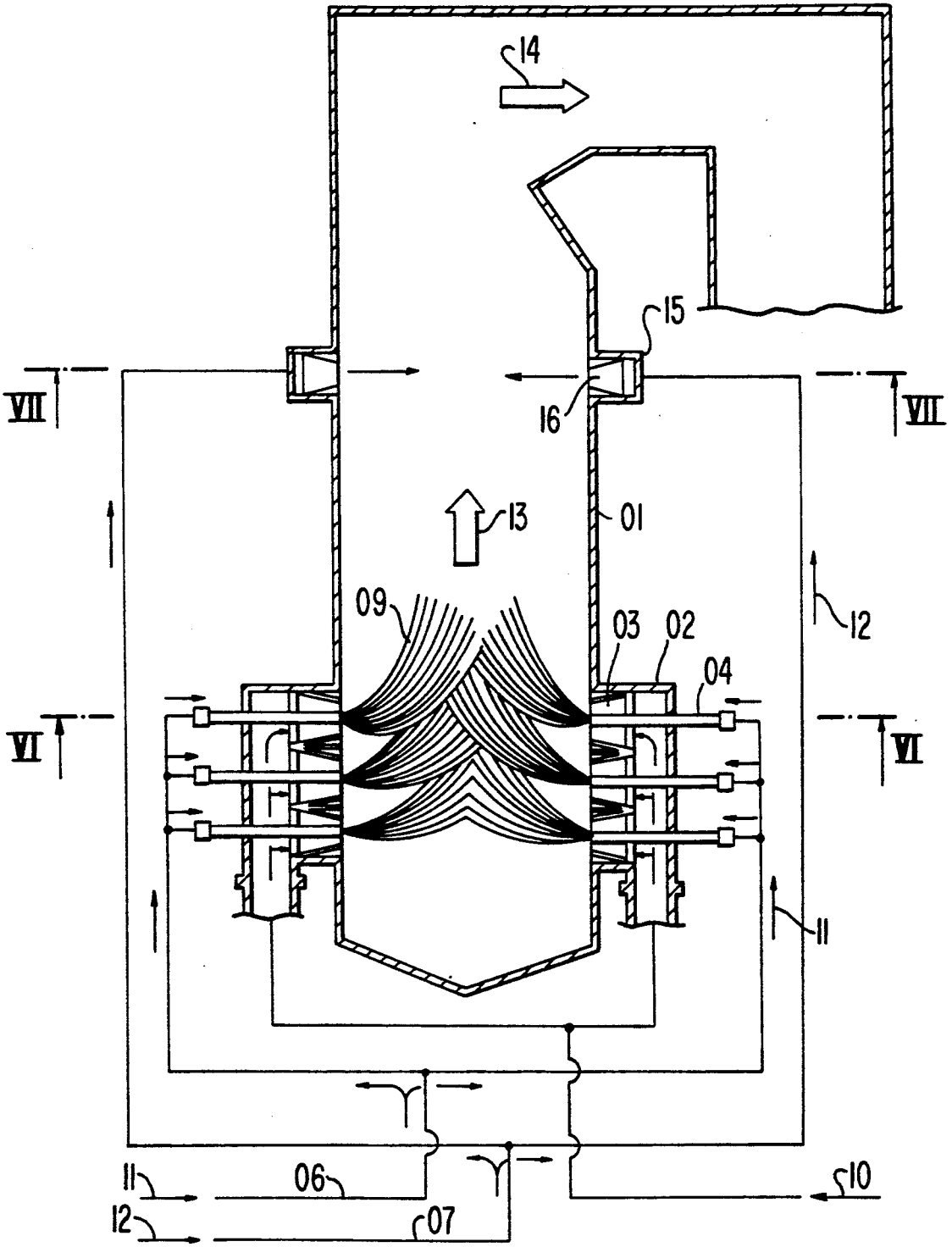
FIG. 5 (PRIOR ART)
FIG. 5 is a longitudinal cross-sectional view of one example of a boiler furnace in the prior art.
Figure 6:
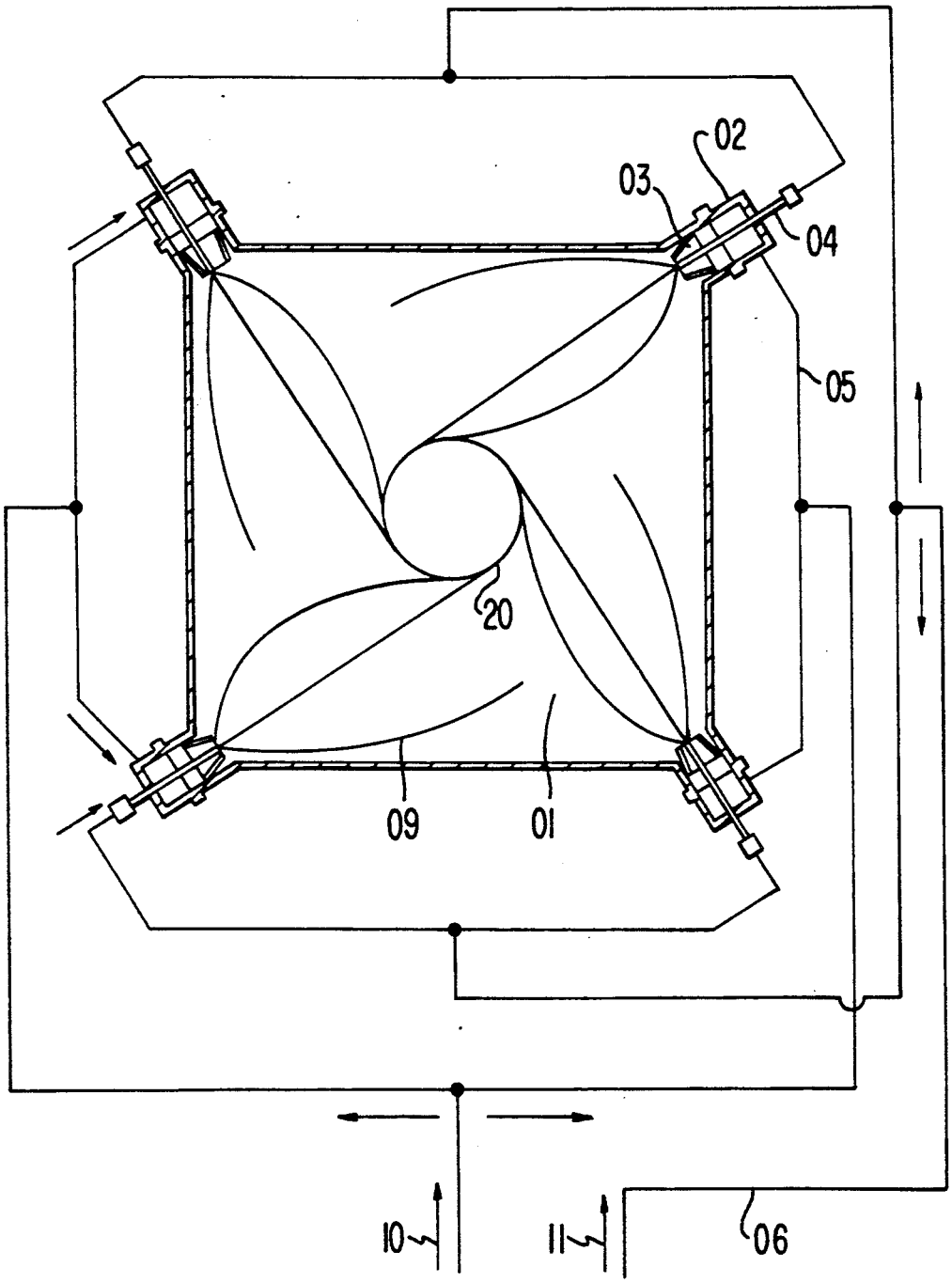
FIG. 6 (PRIOR ART)
FIG. 6 is a transverse cross-sectional view of the same taken along line VI—VI in FIG. 5.
Figure 7:
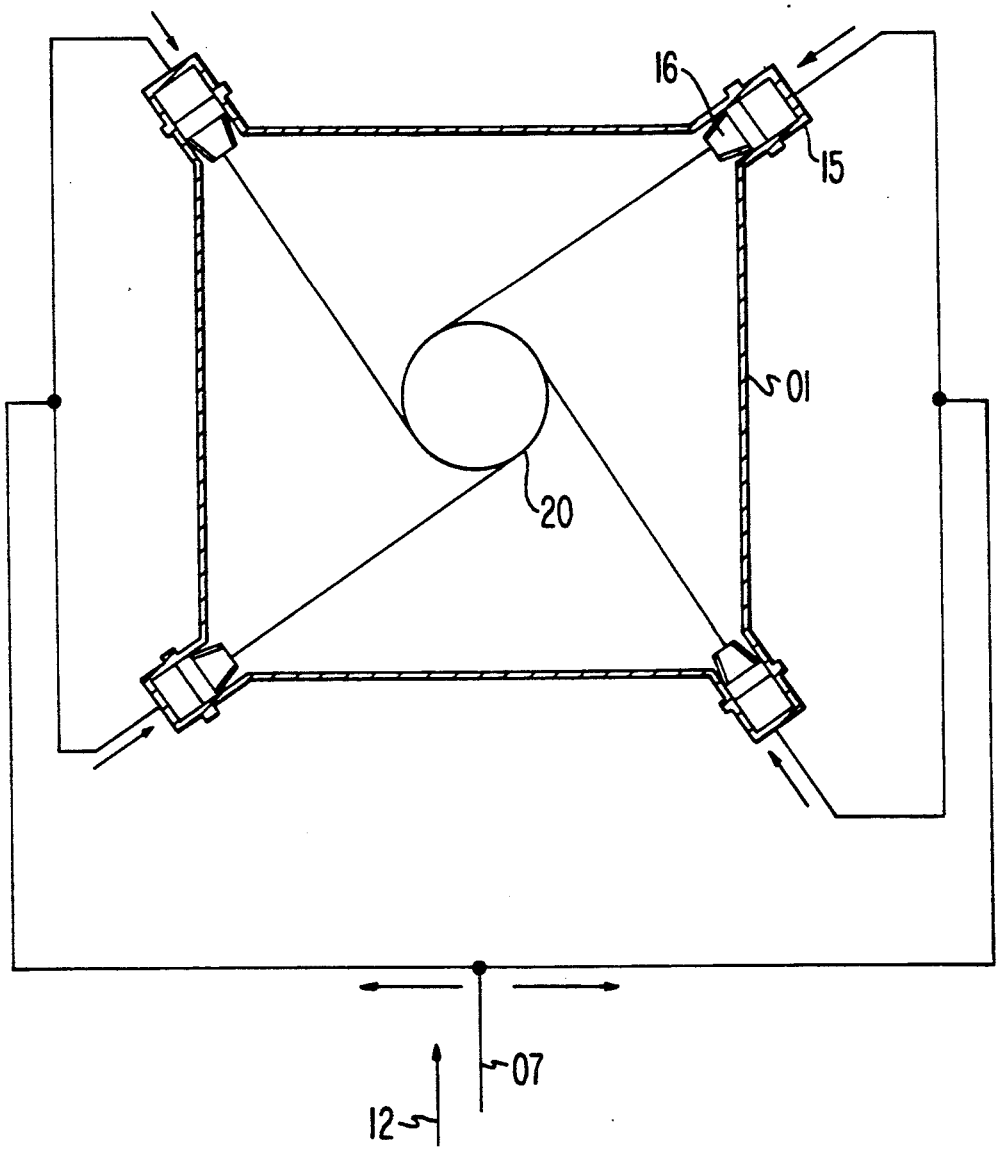
FIG. 7 (PRIOR ART)
FIG. 7 is another transverse cross-sectional view of the same taken along line VII—VII in FIG. 5.

One preferred embodiment of the present invention is generally shown in FIGS. 1 to 4. In these figures, reference numerals 01 to 14 designate component parts similar to those in the boiler furnace in the prior art illustrated in FIGS. 5 to 7 and described previously. On the other hand, reference numeral 115 designates upstream side (lower level) AA wind boxes, numeral 116 designates upstream side (lower level) AA nozzles, numeral 117 designates downstream side (upper level) AA wind boxes, numeral 118 designates downstream side (upper level) AA nozzles, numeral 119 designates upstream side (lower level) AA (additional air), and numeral 120 designates downstream side (upper level) AA (additional air).

Fuel 11 sent from a fuel feed installation (not shown) through fuel feed pipes 06 and main burner air 10 sent likewise from a ventilating installation (not shown) through main burner air ducts 05, are respectively injected through main burner air fuel injection nozzles 04 and burner air nozzles 03 into a boiler furnace 01. The injection of the fuel 11 and of the main burner air 10 are effected in a tangential direction to an imaginary cylindrical surface 20, having an axis aligned with the axis of the boiler furnace 01 (see FIG. 2).

The fuel 11 injected into the boiler 01 is ignited by an ignition source (not shown) and forms flames 09, and as it diffuses and mixes with the main burner air 10 blown in the tangential direction through the main burner air nozzles 03, combustion continues.

Here, the main burner air 10 is fed at a flow rate less than the air flow rate that is theoretically necessary for combusting the fuel 11 injected into the boiler furnace 01. Therefore, the interior portion of the boiler furnace 01 below the AA blowing portion is held under a reducing atmosphere. The combustion of the fuel 11 produces unburnt combustion gas 13 containing unburnt fuel due to a lack of oxygen in the interior portion below the AA blowing portion, and the unburnt combustion gas rises while swirling.

Above the main burner wind boxes 02 of the boiler furnace main body 01 is the AA blowing portion, divided into two groups respectively disposed at higher and lower levels.

In the upstream side (lower level) AA blowing portion at which the unburnt combustion gas 13 first arrives, the upstream side (lower level) AA wind boxes 115 are provided at the respective corner portions of the square-barrel-shaped boiler furnace main body 01. Upstream side (lower level) A nozzles 116 extend nearly horizontally within wind boxes 115 to inject the upstream side (lower level) AA 119 into the flow of the unburnt combustion gas 13 which has risen. The injection of the upstream side (lower level) AA 119 through the upstream side (lower level) AA nozzles 116 is effected in a direction tangential to a second imaginary cylindrical surface 21 having an axis aligned with the axis of the boiler furnace 01 and having a larger diameter than the above-mentioned imaginary cylindrical surface (see FIG. 3).

In the downstream side (upper level) AA blowing portion, the downstream side (upper level) AA wind boxes 117 are provided at the central portions of the respective side walls of the boiler furnace main body 01. The downstream side (upper level) AA nozzles 118 extend nearly horizontally within wind boxes 117 to inject the downstream side (upper level) AA 120 therefrom into the furnace 01. The downstream side (upper level) AA 120 is injected in a direction tangential to a third imaginary cylindrical surface 22 (see FIG. 4) through the downstream side (upper level) AA nozzles 118. This third imaginary cylindrical surface 22 has a smaller diameter than the above-mentioned second imaginary cylindrical surface and its axis aligned with the axis of the boiler furnace 01.

The flow rate of the AA 12 is 10% to 40% of a total combustion air flow rate (a flow rate of main burner air 10 + a flow rate of AA 12). Because this air flow is separated into the upstream side AA 119 and the downstream side AA 120, blowing momenta of the upstream side AA 119 and the downstream side AA 120 both become small compared to that of the main burner air 10. With respect to the upstream side (lower level) AA 119 blown from the respective corner portions of the boiler furnace main body 01, since the distance from the tip end of the blowing nozzle 116 to the central portion of the boiler furnace 01 is long compared to the distance over which the downstream side (higher level) AA 120 is blown from the central portions of the respective side walls (about 1.4 times as long as the latter in the case where the cross section of the boiler furnace 01 is square), depending upon the blowing momentum of the upstream side (lower level) AA 119, the blowing energy may be attenuated and the AA may rise towards the outlet of the boiler furnace 01 without forming a swirling flow and without being sufficiently diffused and mixed with the unburnt combustion gas 13. Accordingly, it is important that the upstream side (lower level) AA 119 should be blown into the swirling flow of the unburnt combustion gas 13 as early as possible immediately after it has been blown into the furnace. This is one of the reasons why the diameter of the second imaginary cylindrical surface 21 is set to be larger than the diameter of the imaginary cylindrical surface 20.

The unburnt combustion gas rises while it is swirling, and as it rises the outer diameter of its swirl flow becomes large. Therefore, in the proximity of the upstream side (lower level) AA blowing portion, a flow rate of the unburnt combustion gas 13 flowing along the walls of the boiler furnace 01 increases. Since the unburnt temperature of the combustion gas 13 is lower as the gas approaches the walls of the boiler furnace 01, in order to make the unburnt component burn perfectly, it is necessary to quickly feed oxygen to a region close to the walls of the boiler furnace 01. The upstream side (lower level) AA 119 is provided to surely mix with the unburnt combustion gas 13 in order to perfectly burn the unburnt component of this unburnt combustion gas 13 in the proximity of the walls of the boiler furnace 01. And, this is also the reason why the diameter of the second imaginary cylindrical surface 21 is set to be larger than that of cylindrical surface 21.

In this way, the unburnt combustion gas 13 diffuses and mixes with the upstream side (lower level) AA 119 in the proximity of the walls of the boiler furnace 01, and while combustion continues, it reaches the downstream side (higher level) AA blowing portion.

Since the downstream side (higher level) A 120 blows through the downstream side (higher level) AA nozzles 118 provided nearly at the central portions of the side walls of the boiler furnace 01, the distance from the nozzles 118 to the third imaginary cylindrical surface 22 at the central portion of the boiler furnace 01 is short. Hence, the blowing momentum attenuates only a little, and therefore, the downstream side (higher level) AA forms a strong swirling flow. Accordingly, the AA diffuses and mixes effectively with the unburnt combustion gas 13 at the central portion of the boiler furnace 01. Thus, an unburnt component of the unburnt combustion gas 13 is burned perfectly, and is exhausted from the outlet of the boiler furnace 01 as combustion exhaust gas 14.

As described above, in the illustrated embodiment, owing to the facts that the AA blowing portion includes two groups of wind boxes and nozzles disposed at higher and lower levels, respectively, and that the upstream side (lower level) AA 119 is injected from the respective corner portions of the boiler furnace 01 to the proximity of the walls of the boiler furnace 01, while the downstream side (higher level) AA 120 is blown from the central portions of the respective side wall surfaces towards the central portion of the boiler furnace 01, the AA 12 and the unburnt combustion gas 13 can surely diffuse and mix with each other, whereby a highly efficient combustion and reduction of the amount of soot and dust can be realized. In addition, because a very complete combustion can be expected to be effected by the AA 12, the combustion under the AA blowing portion can be effected with a lower air-to-fuel ratio than in the prior art.

Figure 8:
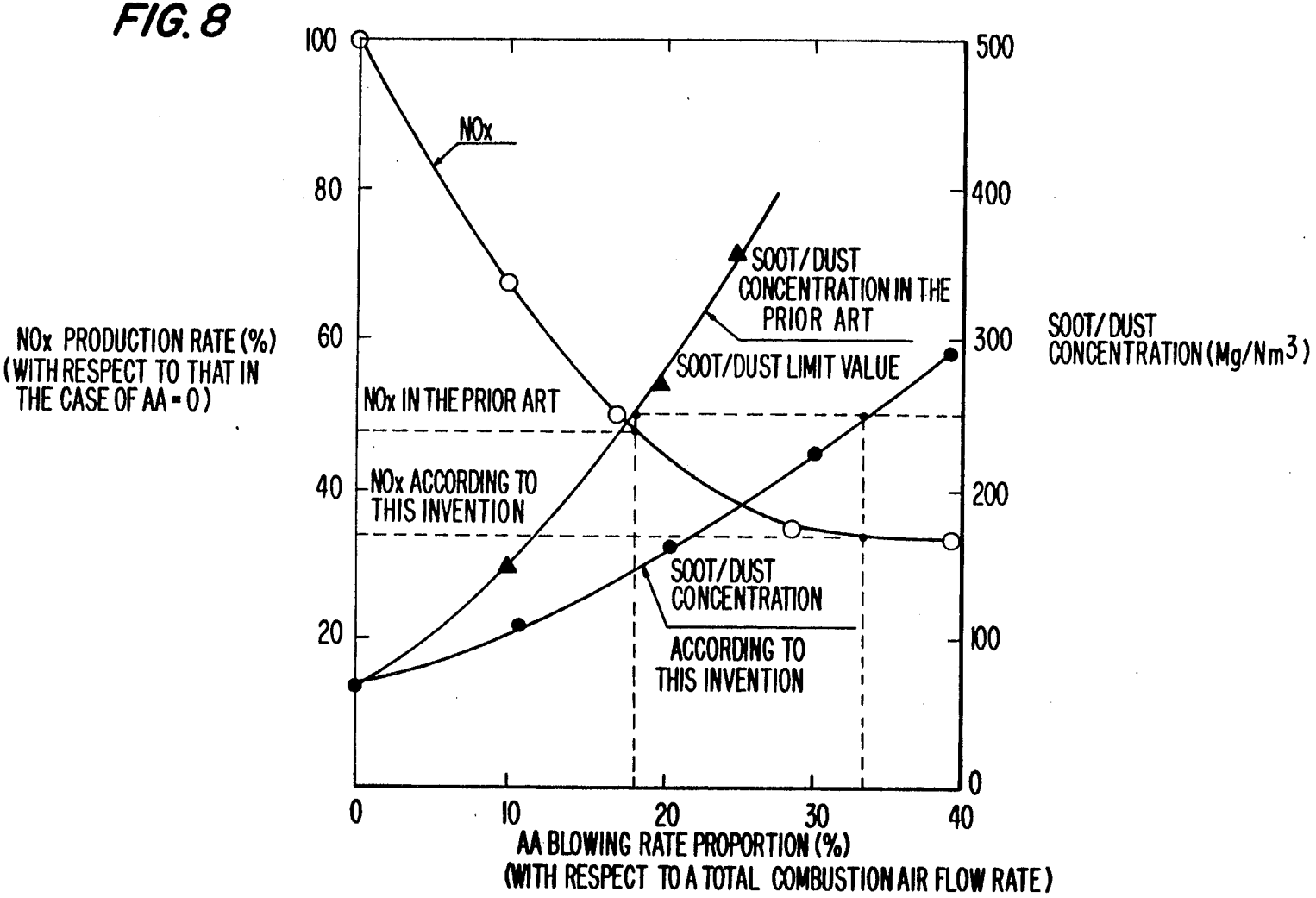
FIG. 8 is a diagram showing relationships between $NO_x$ production rate and a soot/dust concentration versus an AA blowing rate in both the illustrated embodiment and the prior art.

FIG. 8 is a diagram showing relationships of an $NO_x$ production rate and a soot/dust concentration versus an AA blowing rate with respect to both the illustrated embodiment and the prior art. This data is the result of tests conducted by the inventors on a test furnace using pulverized coal as fuel. With respect to this data, the relationship between the $NO_x$ production rate and the AA blowing rate constitute generally well-known characteristics. In the case where petroleum or gaseous fuel is used in place of the pulverized coal, similar characteristics are also observed.

In FIG. 8, the left ordinate represents the proportion (%) of $NO_x$ at the outlet of the furnace, and the right ordinate represents a soot/dust concentration (mg/Nm$^3$) in combustion exhaust gas at the outlet of the furnace. Also, the abscissa represents a ratio (%) of the AA flow rate to a total combustion air flow rate.

As will be seen from FIG. 8, the amount of $NO_x$ at the outlet of the furnace tends to become lower as the AA flow rate proportion increases. However, in the boiler furnace combustion system in the prior art, as the soot/dust concentration at the outlet of the furnace reaches a soot/dust limit value (250 mg/Nm$^3$) at an AA flow rate proportion of 18%, the AA flow rate proportion cannot be increased further. Therefore, the $NO_x$ production rate cannot be suppressed to a lower value. In the illustrated embodiment, however, the soot/dust concentration at the outlet of the furnace reaches the soot/dust limit value when the AA blowing rate proportion is 33%. Therefore, the $NO_x$ production rate is about 30% lower than that in the prior art.

This is due to the fact that as a result of employing a relatively high AA flow rate proportion, that is, a low main burner air flow rate proportion—a flow rate of main burner air 10/(a flow rate of fuel 11 x a theoretical air flow rate)—a reducing atmosphere is formed in the region below the AA blowing portion. Therefore, the $NO_x$ produced by combustion of the fuel 11 is resolved and transformed into nitrogen molecules $N_2$ and intermediate products such as $NH_3$, HCN and the like. The proportion of $NO_x$ being transformed into $N_2$, $NH_3$, HCN and the like increases as an air-to-fuel ratio in the region below the AA blowing portion decreases (however, at a ratio lower than a certain air-to-fuel ratio, this phenomenon is reversed). While the NH and HCN produced in the region below the AA blowing portion are oxidized and retransformed into $NO_x$ by the AA 119 and 120, if a reducing reaction in the region below the AA blowing portion is effected efficiently and the AA 119 and 120 are flowing uniformly, small proportions of $NH_3$ and HCN are retransformed into $NO_x$, and the $NO_x$ production rate at the outlet of the boiler furnace 01 is suppressed to a low value.

As described in detail above, in the illustrated embodiment, since a highly efficient combustion can be carried out by the AA 190 and 120, the AA flow rate proportion can be set to a large value, whereby a low $NO_x$ production rate, which could not be realized in the prior art, can be achieved.

It is to be noted that while in the above-described embodiment the AA is injected at two levels (upper and lower), in the case of a large-capacity boiler in which the boiler furnace main body 01 is large, the upstream side (lower level) AA nozzles 116 and the downstream side (higher level) AA nozzles 118 could be provided in a number of pairs.

According to the present invention, owing to the fact that the AA is injected at least two upper and lower levels, and the upstream side (lower level) AA is blown from the respective corner portions of the boiler furnace into the unburnt combustion gas in the proximity of the furnace wall surfaces, the unburnt combustion gas and the AA are reliably diffused and mixed. In addition, taking into consideration the fact that the temperature of the unburnt combustion gas becomes lower as the gas nears the furnace wall surfaces, the upstream side (lower level) AA is used to promote combustion in the proximity of the wall surface, while the downstream side (higher level) AA is used to promote combustion at the central portion of the furnace. Therefore, a high combustion efficiency is realized, and moreover, a low air-to-fuel ratio in the main burner combustion zone (under the AA blowing portion) can be maintained. As a result, low-$NO_x$ production and low-unburnt-component combustion can be achieved.

While a principle of the present invention has been described above in connection with one preferred embodiment of the invention, it is intended that all matter contained in the above description and illustrated in the accompanying drawings shall be interpreted to be illustrative and not in a limiting sense.

What is claimed is:

1. In a boiler having a vertically extending square barrel-shaped furnace formed by side walls intersecting at corner portions and defining a longitudinal axis centrally thereof, a combustion system comprising:

a plurality of main burners disposed nearly horizontally on the side walls or at the corner portions of the furnace, said main burners defining axes along which fuel is injected into a main fuel combustion region of the furnace by the main burners, said axes of the main burners extending tangentially to an imaginary cylinder coaxial with the furnace;

fuel supply means and air supply means for supplying fuel to said main burners and introducing air into the main fuel combustion region in amounts sufficient to produce a reducing atmosphere or an atmosphere of a low oxygen concentration of 1% or less in the main fuel combustion region;

at least one group of air nozzles located at a lower level above the main fuel combustion region for injecting additional air into the furnace above the main combustion region, and air supply means for blowing air through said air nozzles disposed at the lower level, the air nozzles at said lower level being disposed at said corner portions of the furnace and defining axes, respectively, along which additional air is injected into the furnace, the axes of said air nozzles at said lower level extending tangentially to a second imaginary cylinder coaxial with the furnace and having a diameter larger than that of said first imaginary cylinder; and at least one group of air nozzles located at an upper level above said lower level for also injecting additional air into the furnace, and air supply means for blowing air through said air nozzles at the upper level, the air nozzles at said upper level being disposed at portions of the side walls of the furnace located centrally of the corner portions, respectively, and defining respective axes along which additional air is also injected into the furnace, the axes of said air nozzles at said upper level extending tangentially to a third imaginary cylinder coaxial with the furnace and having a diameter smaller than that of said second imaginary cylinder.

2. A combustion system in the furnace of a boiler as claimed in claim 1, wherein said air supply means blows air through said air nozzles at an additional air flow rate of between 10% to 40% of a total flow rate of combustion air, wherein said total flow rate is the sum of the flow rate at which air is introduced into the main fuel combustion region and said additional air flow rate.

3. A combustion system in the furnace of a boiler as claimed in claim 1, wherein a common source of air constitutes said air supply means.

4. A combustion system in the furnace of a boiler as claimed in claim 1, wherein separate sources of air constitute the air supply means for supplying air to said air nozzles and the air supply means for introducing air into said main fuel combustion region, respectively.

* * * * *